US005873418A

United States Patent [19]

Arakawa et al.

[11] Patent Number: 5,873,418

[45] Date of Patent: Feb. 23, 1999

[54] PERCUSSIVE TOOL HAVING A REDUCED IMPACT AT THE START OF PERCUSSIVE OPERATION

[75] Inventors: Takuo Arakawa; Masaki Sakuragi, both of Anjo, Japan

[73] Assignee: Makita Corporation, Aichi, Japan

[21] Appl. No.: 826,221

[22] Filed: Mar. 27, 1997

[30] Foreign Application Priority Data

Mar. 29, 1996 [JP] Japan ..... 8-076944

[51] Int. Cl.[6] ..... B25D 11/04

[52] U.S. Cl. ..... 173/212; 173/109; 173/201; 173/48

[58] Field of Search ..... 173/109, 104, 173/200, 201, 48, 14, 139, 212, 210

[56] References Cited

U.S. PATENT DOCUMENTS

| | | | |
|---|---|---|---|
| 4,567,951 | 2/1986 | Fehrle et al. | 173/201 |
| 4,582,144 | 4/1986 | Mizutani et al. | 173/201 |
| 4,611,670 | 9/1986 | Chromy | 173/201 |
| 4,719,976 | 1/1988 | Bleicher et al. | 173/201 |
| 4,823,886 | 4/1989 | Dyatov | 173/14 |
| 4,825,961 | 5/1989 | Neumaier et al. | 173/109 |
| 5,111,890 | 5/1992 | Ranger et al. | 173/104 |

FOREIGN PATENT DOCUMENTS

| | | |
|---|---|---|
| 62-174887 | 6/1987 | Japan . |
| 622 732 A5 | 8/1977 | Switzerland . |

*Primary Examiner*—Scott A. Smith
*Attorney, Agent, or Firm*—Lahive & Cockfield, LLP

[57] ABSTRACT

A percussive tool generates a reduced impact at the start of percussive operation following idling operation. The percussive tool has a cylinder containing a piston, an air chamber in front of the piston, and a striker disposed in front of the air chamber. A slide sleeve and a rimmed ring at the rear end thereof are fitted around the cylinder. The cylinder has formed therein an exhaust port and auxiliary ports in front of the exhaust port for placing the air chamber in communication with the atmosphere. When the slide sleeve is retracted, the exhaust port is closed by the rimmed ring. During percussive operation of the percussive tool, the auxiliary ports are always closed by the reciprocating striker and therefore not open to the air chamber. During idling operation, the striker takes an advanced position and opens the auxiliary ports, thereby placing the air chamber in communication with the atmosphere. The distance between the rear end of the striker and the auxiliary ports is set slightly shorter than the distance between the rear end of the ring and the exhaust port in normal operation, so that the auxiliary ports are opened prior to the exhaust port.

10 Claims, 8 Drawing Sheets

PERCUSSIVE TOOL HAVING A REDUCED IMPACT AT THE START OF PERCUSSIVE OPERATION

BACKGROUND OF THE INVENTION

1. Field of the Invention

This invention relates to electric hammers, hammer drills or other types of percussive tools having an idle strike preventive mechanism. More particularly, this invention relates to such a percussive tool in which the idle strike preventive mechanism incorporates an additional mechanism to lessen the impact at the start of normal percussive operation following idling operation.

2. Description of the Prior Art

FIG. 8 shows Japanese Published Unexamined Utility Model Application No. 62-174887, which discloses an idle strike preventive mechanism for use in an electric hammer. In this mechanism, a cylinder 40 contains a reciprocating piston 41, an air chamber 42, and a striker 43 interlocked with the piston 41 via the air chamber 42. An axially slide sleeve 45 is mounted over the cylinder 40 and urged forward (toward a tool bit 47) by means of a compression spring 44. Also, an exhaust port 48 is formed in the cylinder 40 for connecting the air chamber 42 with the atmosphere. According to this construction, when the tool bit 47 is pressed against the ground or a workpiece, the slide sleeve 45 is retracted to a rear position together with an intermediate member 46 which is disposed between the tool bit 47 and the striker 43. The retracted slide sleeve 45 closes the exhaust port 48, thereby creating an air spring within the air chamber 42 (and pneumatically interlocking the striker 43 with the piston 41). On the other hand, during idle strikes, in which the tool bit 47 is not pressed against the ground or when the tool bit 47 is not mounted at all, the slide sleeve 45 advances together with the intermediate member 46, thus opening the exhaust port 48. The air spring created in the air chamber 47 is lost, eliminating the interlock between the piston 41 and the striker 43.

Notwithstanding the capability to break the interlock between the piston 41 and the striker 43, the prior art idle strike preventive mechanism falls short in the following respect.

While idle strikes are prevented by the mechanism, the tool bit 47, the intermediate member 46, the striker 43 are located in a forward position. To restore normal operation from idling operation, the tool bit 47 is pressed against the ground. In this way, the tool bit 47 and the intermediate member 46 are retracted, pushing back the slide sleeve 45, which then closes the exhaust port 48 to place the air chamber 42 suddenly in a sealed condition. Also, the striker 43 is simultaneously pushed back by the retracted intermediate member 46 to be interlocked with the piston 41. The air spring created in the suddenly sealed air chamber 42 causes an abrupt retraction of the striker 43 at the start of its interlock with the piston 41. The striker 43, being abruptly retraced, causes a strong impact or jolt at the beginning of the subsequent percussive operation. The impact is problematic not only because it lowers the operability of the hammer drill, but also because it causes the tool bit to jump on the workpiece and to chip off the edge of the drilled bore.

SUMMARY OF THE INVENTION

In view of the above-identified problem, it is an object of the present invention to provide a percussive tool that causes a reduced jolt at the beginning of normal percussive operation following idling operation.

The above object and other related objects are realized by providing a percussive tool which includes: a cylinder; a piston contained and reciprocable in the cylinder; an air chamber formed adjacent to the piston in the cylinder for creating an air spring therein; at least one exhaust port formed in the part of the cylinder where the air chamber is located; a striker element contained in the cylinder and capable of being interlocked with the piston via the air spring created in the air chamber to transmit a percussive motion performed by the piston to a tool, bit mounted at the front end of the percussive tool; and an axially displaceable slide sleeve mounted around the cylinder and urged forward. The slide sleeve is retracted to close the exhaust port formed in the cylinder when the percussive motion is transmitted. The slide sleeve is advanced to open the exhaust port during idling operation. The percussive tool further includes ventilation control means formed in the cylinder for restraining the effect of the air spring in the air chamber by placing the air chamber in communication with the atmosphere at least for a predetermined time period after the exhaust port is closed by the slide sleeve during a switchover from idling operation to normal percussive operation.

In one aspect of the present invention, the ventilation control means comprises at least one auxiliary port formed in the cylinder in front of the exhaust port. The auxiliary port is closed by the striker element when the striker element moves backward while reciprocating during the switchover from idling operation to normal percussive operation.

In another aspect of the present invention, the auxiliary port is located in front of the rear end of the striker element when the striker element is in its forward position in normal percussive operation.

In still another aspect of the present invention, the auxiliary port is located so that the rear end of the striker element covers part of the auxiliary port with the remaining part thereof open to the air chamber when the striker element is in its forward position in normal percussive operation.

In still another aspect of the present invention, the percussive tool further comprises: a second air chamber formed in the cylinder in front of the striker element; at least one front port formed in the cylinder for placing the second air chamber in communication with the atmosphere; and at least one movable aperture formed in the slide sleeve for opening the front port when the slide sleeve is in the retracted position in normal percussive operation. The front port is closed by the slide sleeve when the slide sleeve is in the advanced position in idling operation.

The present invention further provides for a percussive tool that includes: a cylinder; a piston contained and reciprocable in the cylinder; an air chamber formed adjacent to the piston in the cylinder for creating an air spring therein; at least one exhaust port formed in the part of the cylinder where the air chamber is located; a striker element contained in the cylinder and capable of being interlocked with the piston via the air spring created in the air chamber to transmit a percussive motion performed by the piston to a tool bit mounted at the front end of the percussive tool; and an axially displaceable slide sleeve mounted around the cylinder and urged forward. The slide sleeve is retracted to close the exhaust port formed in the cylinder when the percussive motion is transmitted. The slide sleeve is advanced to open the exhaust port during idling operation. The percussive tool further includes a second air chamber formed in the cylinder in front of the striking element and ventilation control means for restraining the effect of the air spring in the air chamber by placing the air chamber in communication with the second air chamber at least for a predetermined time period after the exhaust port is closed by the slide sleeve during a switchover from idling operation to normal percussive operation.

According to one practice of the invention, the ventilation control means comprises a recess formed in the inner surface of the cylinder and an air path formed around the peripheral surface of the striker element, the air path extending from part of the striker element near its rear end to the second air chamber. The recess is only partially closed by the striker element when the exhaust port is completely closed by the slide sleeve, thereby placing the air chamber in communication with the second air chamber.

BRIEF DESCRIPTION OF THE DRAWINGS

For a fuller understanding of the nature and objects of the present invention, reference should be made to the following detailed description and the accompanying drawings, in which.

DETAILED EXPLANATION OF THE PREFERRED EMBODIMENT

Figure 1:
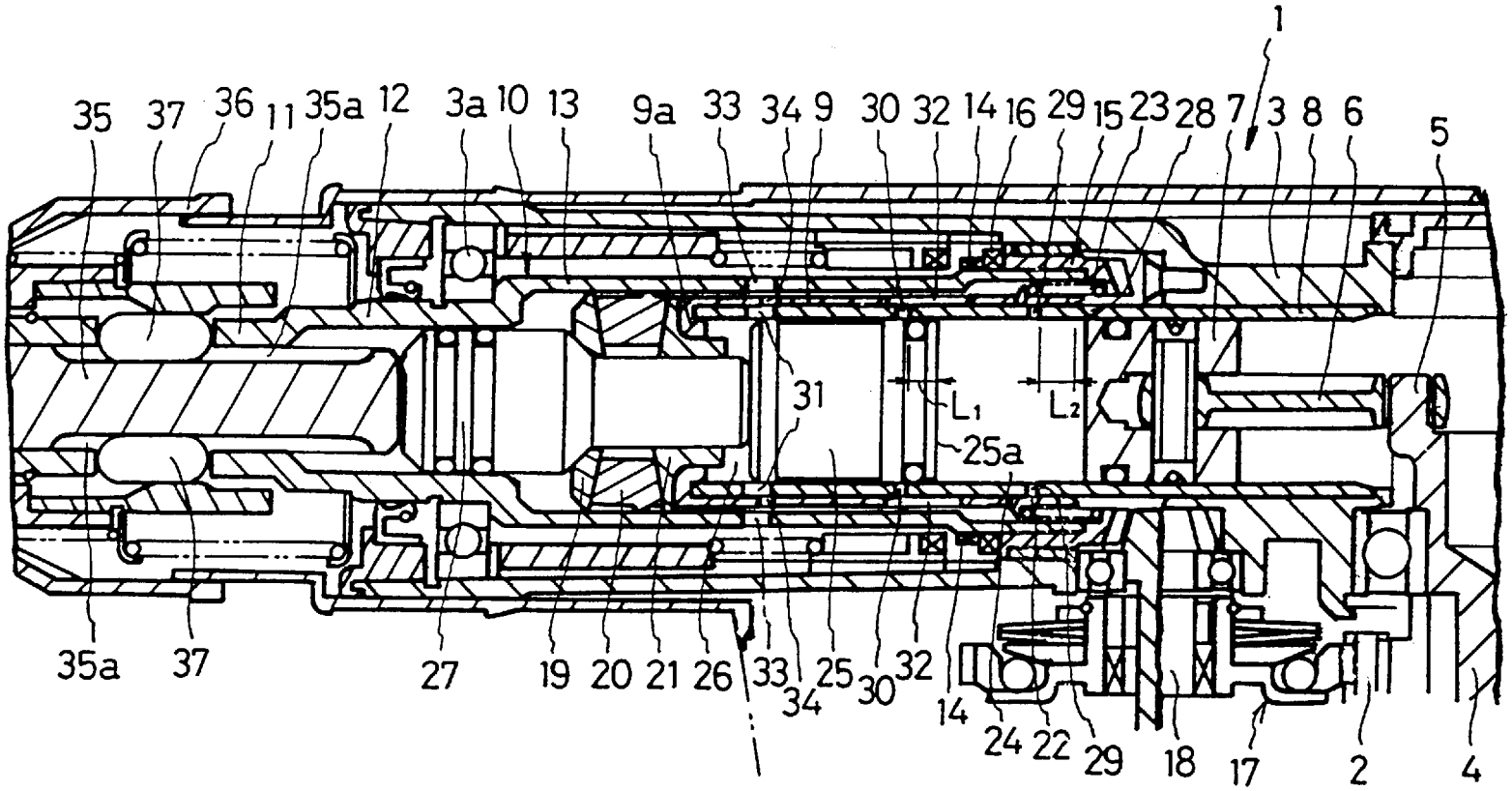
FIG. 1 is a vertical sectional view of a hammer drill according to the first embodiment of the present invention.

FIG. 1 shows a cross section of a hammer drill 1 which is provided with a motor shaft 2 in the rear part thereof encased in a housing 3 for rotating a crank shaft 4. (In the following explanation, the left hand side in FIG. 1, where a tool bit 35 is situated, is referred to as the front.) The crank shaft 4 is supported in the direction perpendicular to the axial direction of the hammer drill 1. The crank shaft 4 has an eccentric pin 5 projected therefrom. The eccentric pin 5 is coupled to a piston 7 via a connecting rod 6. With this construction, the rotation of the motor shaft 2 can be converted to a reciprocating movement of the piston 7.

The piston 7 is placed in a cylinder 8 which is secured to the housing 3 at its rear portion and extends in the forward direction. The front portion of the cylinder 8 is coaxially surrounded by a slide sleeve 9 and a tool holder 20. The tool holder 10 is composed of a small bore portion 11 for receiving the tool bit 35, a middle bore portion 12 which is supported by ball bearings 3*a* provided on the housing 3, and a large bore portion 13 fitted around the slide sleeve 9 with a slight clearance therebetween. The small bore portion 11 are protruded out of the housing 3 with a pair of rollers 37 mounted on the protruding part of the small bore portion 11. Pressed by a chuck sleeve 36, the rollers 37 engage grooves 35*a* formed in the tool bit 35 so as to firmly hold the tool bit 35. The large bore portion 13 has protrusions 14 formed on its periphery. The protrusions 14 are meshed with teeth 16 formed on the front end of a bevel gear 15 mounted around the large bore portion 13. The bevel gear 15 is in turn engaged with a shaft 18 which is connected to the motor shaft 2 via a transmission mechanism 17, so that the motor shaft 2 can rotate the tool holder 10.

The cylindrical slide sleeve 9 is disposed between the large bore portion 13 of the tool holder 10 and the cylinder 8 so as to be displaceable in the axial direction. A washer 19, a rubber 20 and a holder 21 are reciprocably provided between the slide sleeve 9 and the middle bore portion 12. The slide sleeve 9 can move backward until an inwardly extending flange 9*a* formed at the front end thereof abuts on the front end of the cylinder 8. Also, the slide sleeve 9 can slide forward until the washer 19, the rubber 20 and the holder 21 abut on the rear end of the middle bore portion 12. A rimmed ring 22 is fitted around the cylinder 8 behind the slide sleeve 9. A compression spring 23 is disposed between the rimmed ring 22 and the bevel gear 15 to urge the slide sleeve 9 and the rimmed ring 22 in the forward direction.

Figure 2:
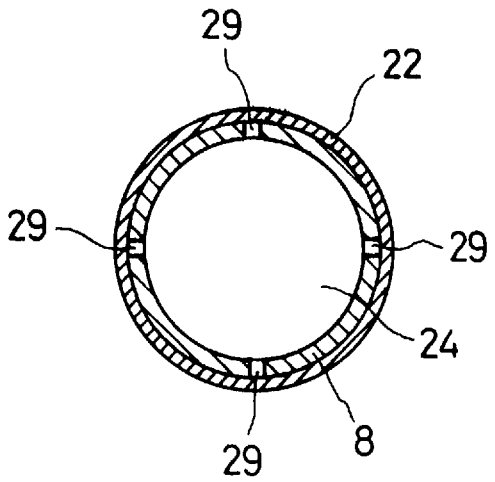
FIG. 2 is a cross sectional view of the exhaust ports, the cylinder, and the rimmed ring of the hammer drill shown in FIG. 1.

The cylinder 8 contains a striker 25 which is reciprocable therein, an air chamber 24 formed between the striker 25 and the piston 7, and a second air chamber 26 formed in front of the striker 25. An intermediate member 27 is reciprocably contained within the middle bore portion 12 of the tool holder 10. One air replenishment port 28 and four exhaust ports 29 are formed in the part of the peripheral wall of the cylinder 8 where the air chamber 24 is formed. Four auxiliary ports 30 are formed in the cylinder 8 in front of the air chamber 24. The cylinder 8 has also four front ports 31 formed therein where the second air chamber 26 is formed. The air replenishment port 28 replaces the air lost from the air chamber 24. The exhaust ports 29 are closed by the rimmed ring 22 as shown in FIG. 2 when the slide sleeve 9 is retracted to the position in which the inwardly extending flange 9*a* abuts on the front end of the cylinder 8. The auxiliary ports 30 are normally positioned in front of the rear end 25*a* of the striker 25 during normal percussive operation and therefore are not in pneumatic communication with the air chamber 24. During idling operation, the auxiliary ports 30 is in pneumatic communication with the air chamber 24 since the rear end 25*a* of the striker 25 advances past the auxiliary ports 30. When the striker 25 is in its forward position in normal percussive operation, the distance L1 between the auxiliary ports 30 and the rear end 25 *a*of the striker 25 is slightly shorter than the distance L 2 between the rear end of the rimmed ring 22 and the exhaust ports 29. The rimmed ring 22 has an inclined end surface to allow gradual air flow when the exhaust ports 29 are opened. Therefore, the distance L2 is, to be precise, between the exhaust ports 29 and the point at which the inclined end surface of the rimmed ring 22 contacts the cylinder 8. Due to the difference between the distances L1 and L2, the auxiliary ports 30 remain open even when the slide sleeve 9 is retracted to close the exhaust ports 29. However, the size of the auxiliary ports 30 is so determined as to create a reduced but still sufficient air spring in the air chamber 24 to pneumatically interlock the piston 7 with the striker 25. A similar size consideration is made for the modified auxiliary ports that will be described later in detail.

Provided in the approximately middle portion of the slide sleeve 9 are movable apertures 32 with a larger diameter than that of the auxiliary ports 30. The movable apertures 32 maintain the auxiliary ports 30 in pneumatic communication with the atmosphere under any operating condition.

Furthermore, the large bore portion 13 of the tool holder 10 has six through holes 33 formed therein surrounding the four front ports 31 formed in the cylinder 8. Also, second movable apertures 34 are formed in the front portion of the slide sleeve 9 and interposed between the front ports 31 and the through holes 33 to establish their pneumatic communication during normal percussive operation.

In normal operation of the hammer drill 1, the tool bit 35 is inserted from the top end of the tool holder 10, and then pressed against, for example, the ground. This causes the intermediate member 27 to retract and, in turn, causes the washer 19, the rubber 20, the holder 21, the slide sleeve 9, and the rimmed ring 22 to retract against the urging pressure of the compression spring 23, and to take their respective positions shown in FIG. 1. With the exhaust ports 29 closed by the rimmed ring 22, reciprocating movement of the piston 7 creates an air spring within the air chamber 24, thereby interlockingly driving the striker 25 to strike the intermediate member 27 at its rear end protruding into the second air chamber 26. The reciprocating movement of the piston 7 is thus effectively transmitted to the tool bit 35 as percussive movement. In addition, since the second air chamber 26 is in communication with the atmosphere via the second movable apertures 34 intermediate between the front ports 31 and the through holes 33, no pneumatic repulsion is created in the second air chamber 26 to reduce the striking force transmitted.

Figure 3:
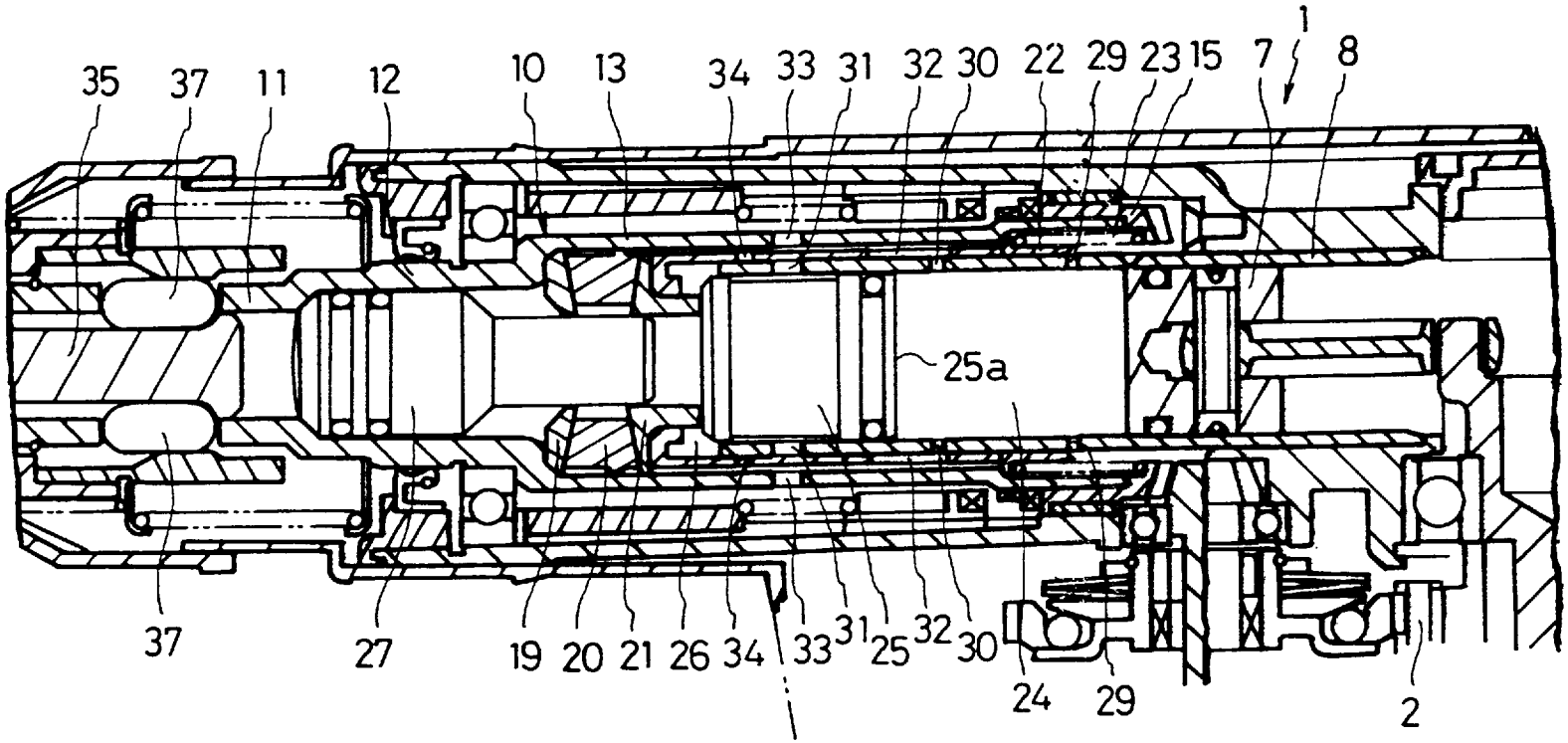
FIG. 3 is a vertical cross sectional view of the idle strike preventive mechanism of the hammer drill shown in FIG. 1.
Figure 4:
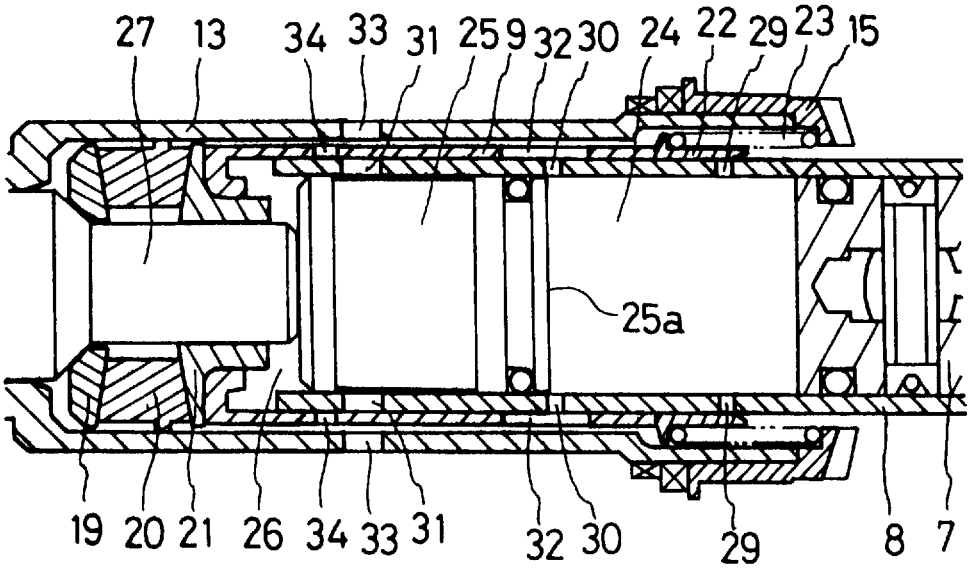
FIG. 4 is a cross sectional view of the hammer drill in FIG. 1 showing the auxiliary ports still open while the exhaust ports are closed.

FIG. 3 shows the hammer drill 1 in idling operation in which the tool bit 35 is not attached or pressed against the ground or a workpiece. At the start of such idling operation, the striker 25 advances to bring the intermediate member 27 into abutment contact with the small bore portion 11. The washer 19, the rubber 20, the holder 21, the slide sleeve 9, and the rimmed ring 22 are also advanced by the urging force of the compression spring 23 to assume their respective positions as shown in FIG. 3. Meanwhile, with the rear end 25*a* of the striker 25 advancing past the auxiliary ports 30, the auxiliary ports 30 arc connected to the air chamber 24, placing the air chamber 24 in communication with the atmosphere as shown in FIG. 4. Then, the exhaust ports 29 arc opened by the advancement of the rimmed ring 22. These events occur in this sequence due to the aforementioned difference between the described distances L1 and L2. When the striker 25 stops in the position where it abuts against the rear end of the intermediate member 27, further idle strikes are prevented, placing the tool in the idle strikes prevention mode. In addition, since the movable apertures 34 are moved forward with the slide sleeve 9, the front ports 31 are no longer in pneumatic communication with the through holes 33. Meanwhile, the air sealed in the second air chamber 26 effectively restrains the thrust of the striker 25 while the negative pressure in the second chamber also prevents the striker 25 from bouncing back toward the piston 7.

To restore the normal operation of the hammer drill 1 from idling operation as shown in FIG. 3, in which idle strikes are prevented, the tool bit 35 is pressed against the ground. The intermediate member 27 is retracted in response, moving back the washer 19, the rubber 20, the holder 21, the slide sleeve 9, and the rimmed ring 22 against the pressure of the compression spring 23. The striker 25 is also retracted toward the piston 7. As shown in FIG. 4, the exhaust ports 29 are closed by the rimmed ring 22 prior to the closure of the auxiliary ports 30. Since the rear end 25*a* of the striker 25 has not closed the auxiliary ports 30 at this moment, the air chamber 24 is still in communication with the atmosphere via the auxiliary ports 30 and the movable apertures 32. In this condition, the striker 25 is retracted by the reciprocating piston 7. As the striker 25 is not powerfully retracted due to the air chamber 24 still being in communication with the atmosphere at this time, the effect of air spring is reduced and the strokes of the reciprocating striker 25 are made shorter. This results in a smaller striking force and a smaller jolt at the start of the percussive operation.

When the reciprocating motion of the piston 7 has retracted the striker 25 to the position where the rear end 25*a* thereof is always located behind the auxiliary ports 30, the air chamber 24 is in no longer communication with the atmosphere but becomes sealed as shown in FIG. 1. Thus, the striker 25 is fully interlocked with the piston 7 and performs its normal striking action with its normal strokes.

It should be apparent from the foregoing explanation that, in the beginning of normal percussive operation following idling operation, the air chamber 24 is gradually sealed to avoid an abrupt retraction of the striker 25. The powerful first impact transmitted by the striker 25 is thus lessened to provide a smooth switchover between the two operation modes (the normal operating mode and the idling mode), thereby preventing an uncomfortable jolt to improve the operability of the hammer drill.

The auxiliary ports 30 are opened and closed according to the position of the striker 25 within the cylinder 8 to selectively interlock the striker 25 with the piston 7. Thus, the above-described smooth switchover proves superior not only at the beginning of normal percussive operation following idling operation, in which idle strikes are prevented, but also under other circumstances. For instance, when the hammer drill 1 is held high and horizontal in drilling operation, the tool bit 35 may not be sufficiently pressed in due to the awkward position of the hammer drill 1. In this case, the exhaust ports 29 may be repeatedly opened and closed in response to the reciprocating movement of the slide sleeve 9. This results in unstable switchover between normal percussive operation and idling operation. However, by virtue of the auxiliary ports 30 reducing the air spring effect within the air chamber 24, the striker 25 is prevented from retracting abruptly even when the hammer drill 1 switches from the idling operation to normal percussive operation. Therefore, the operator is not exposed to extreme impact.

Figure 5:
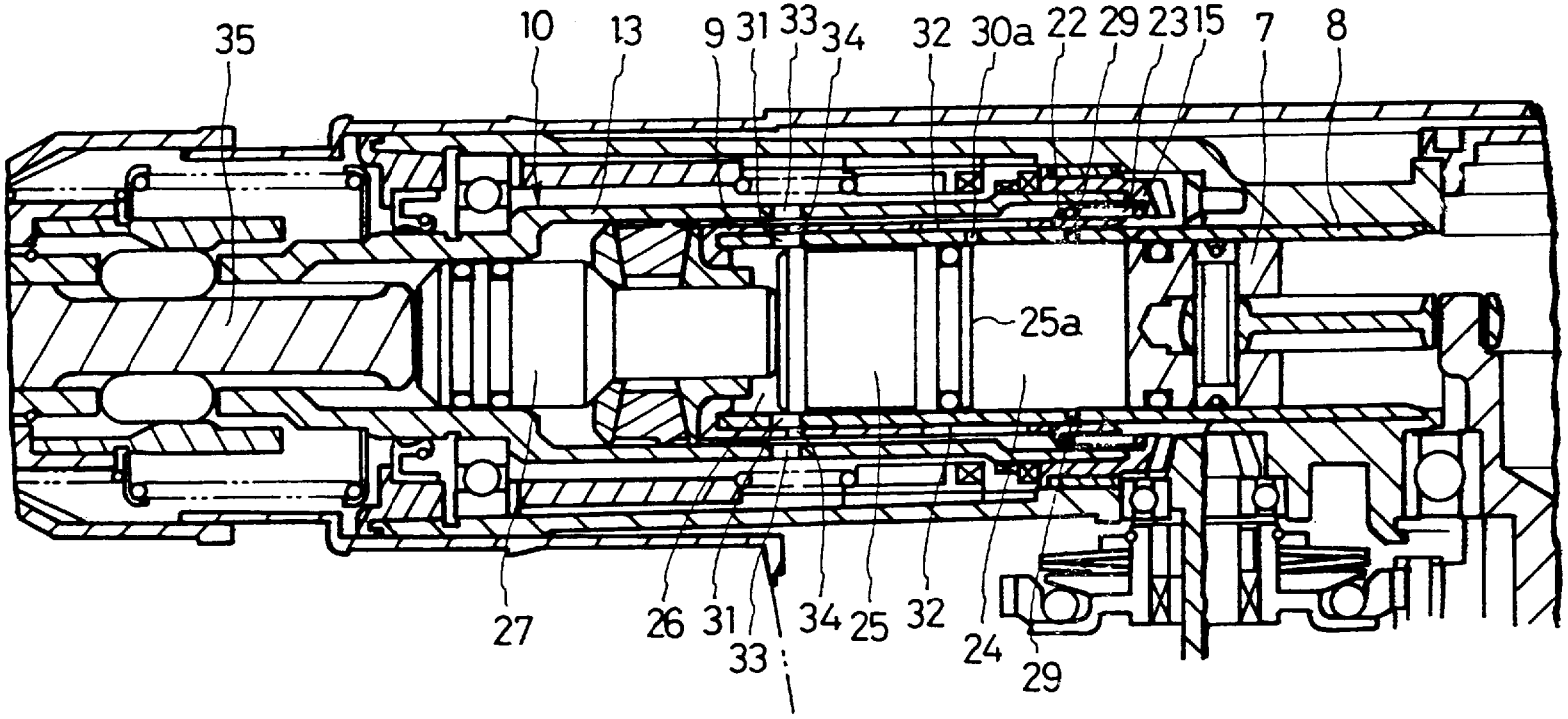
FIG. 5 is a vertical cross sectional view of the hammer drill with modified auxiliary ports.

In the instant embodiment, the auxiliary ports 30 are always located in front of the rear end 25*a* of the striker 25 during normal percussive operation. The auxiliary ports 30, however, may be modified as shown in FIG. 5. The modified auxiliary ports 30*a* are so Located in the cylinder that the rear end 25*a* of the striker 25 covers only part of the ports 30*a* with the remaining part open to the air chamber 24 when the striker 25 is in its forward position in normal operation. In this configuration, the communication between the air chamber 24 and the atmosphere is established when the striker 25 assumes its forward position. However, since the striker 25, upon striking the intermediate member 27, bounces back to immediately close the auxiliary ports 30*a* with the rear end 25*a*, the pneumatic interlock between the striker 25 and the piston 7 is not affected to any significant extent.

Figure 6:
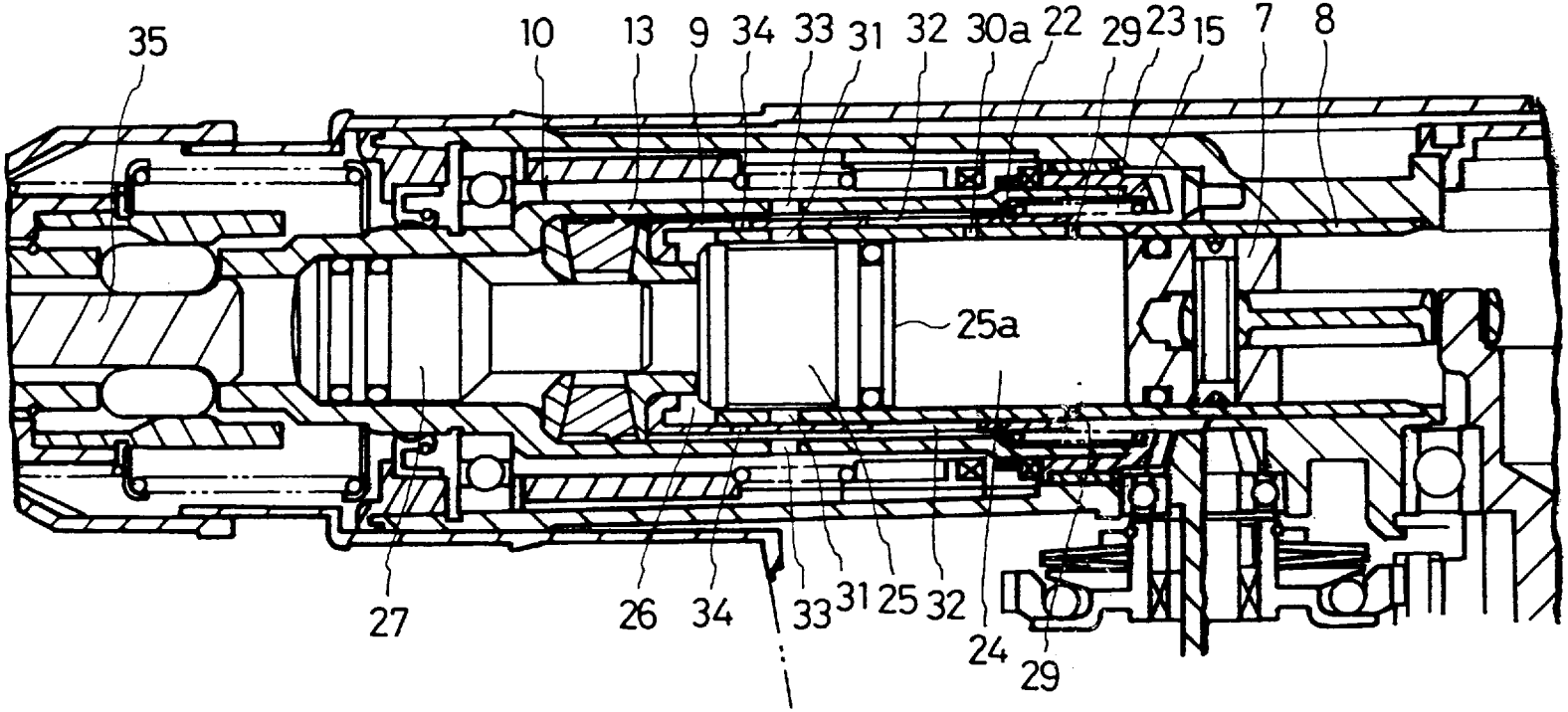
FIG. 6 is another cross sectional view of the hammer drill of FIG. 5 in idling operation.

FIG. 6 shows the hammer drill 1 with the modified auxiliary ports 30*a* in idling operation. When the slide sleeve 9 and the rimmed ring 22 retract from their respective illustrated positions, the rimmed ring 22 immediately closes the exhaust ports 29. Since the distance from the rear end 25*a* of the striker 25 to the auxiliary ports 30*a* is greater than that of the foregoing embodiment, it takes a longer time for the reciprocating and retracting striker 25 to restore its normal strokes and to go into normal operating mode, in which the position of the striker 25 shown in FIG. 5 is its forward position. This means that the above-explained smooth switchover lasts for a longer period of time before normal percussive operation starts, which further enhances the operability of the hammer drill.

Figure 7:
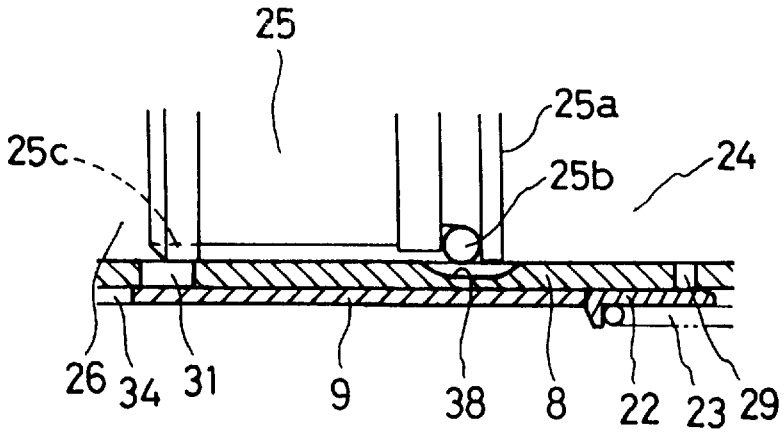
FIG. 7 is a partial cross sectional view showing a modified ventilation controller.
Figure 8:
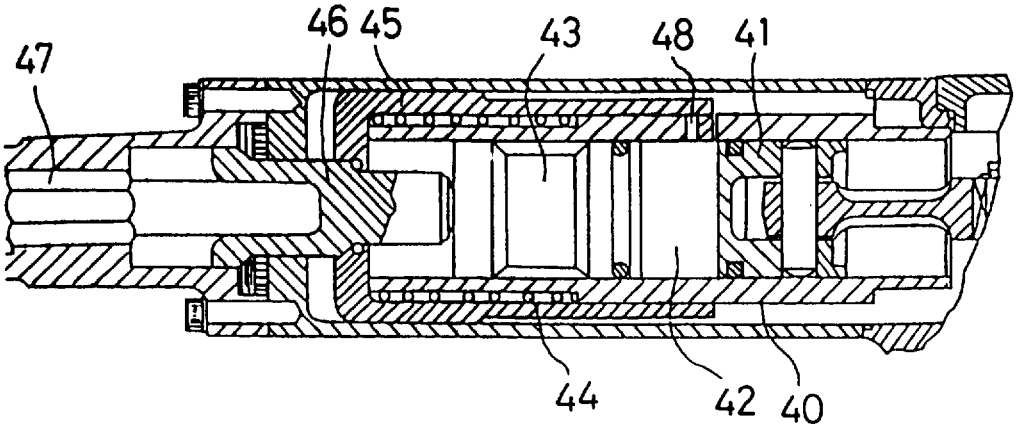
FIG. 8 is a vertical cross sectional view of an electric hammer with a conventional idle strike preventive mechanism.

In the above-explained arrangements, the auxiliary ports 30 and 30*a* function as ventilation control means to attain a smooth switchover from idling operation to normal percussive operation. The same effect can be attained by other configurations. For example, FIG. 7 shows a recess 38 formed in the inner surface of the cylinder 8 and an air path 25*c* formed around the striker 25. The air path 25*c* extends from an O-ring 25*b* to the second air chamber 26. According to this construction, when the exhaust ports 29 are closed by the rimmed ring 22, the rear end 25*a* of the striker 25 is located on, but not completely covering, the recess 38, thereby maintaining the air chamber 24 in pneumatic communication with the second air chamber 26. Therefore, this configuration also provides a smooth switchover from idling operation to normal percussive operation of the percussive tool. It should be noted that the recess 38 may be designed longer in the axial direction than the illustrated example.

The recess and the auxiliary ports may take various other configurations and the number thereof may be changed as long as the smooth switchover is obtained.

As there may be many other modifications, alterations, and changes without departing from the scope or spirit of the essential characteristics of the present invention, it is to be understood that the above embodiment is only an illustration and not restrictive in any sense. The scope or spirit of the present invention is limited only by the terms of the appended claims.

What is claimed is:

1. A percussive tool comprising:

a cylinder;

a piston contained and reciprocable in said cylinder;

an air chamber formed adjacent to said piston in said cylinder for creating an air spring therein;

at least one exhaust port formed in the part of said cylinder where said air chamber is located;

a striker element contained in said cylinder and capable of being interlocked with said piston via said air spring created in said air chamber to transmit a percussive motion performed by said piston to a tool bit mounted at a front end of the percussive tool;

an axially displaceable slide sleeve mounted around said cylinder and urged forward, said slide sleeve being retracted to close said at least one exhaust port formed in said cylinder when said percussive motion is transmitted and being advanced to open said at least one exhaust port during idling operation; and ventilation control means formed in said cylinder for restraining the effect of said air spring in said air chamber by placing said air chamber in communication with the atmosphere at least for a predetermined time period after said at least one exhaust port is closed by said slide sleeve during a switchover from idling operation to normal percussive operation.

2. The percussive tool in accordance with claim 1 wherein said ventilation control means comprises at least one auxiliary port formed in said cylinder in front of said at least one exhaust port, wherein said at least one auxiliary port is closed by said striker element when said striker element moves backward while reciprocating during said switchover from idling operation to normal percussive operation.

3. The percussive tool in accordance with claim 2 wherein said at least one auxiliary port is located in front of the rear end of said striker element when said striker element is in its forward position in normal percussive operation.

4. The percussive tool according to claim 3 further comprising:

a second air chamber formed in said cylinder in front of said striker element;

at least one front port formed in said cylinder for placing said second air chamber in communication with the atmosphere; and at least one movable aperture formed in said slide sleeve for opening said at least one front port when said slide sleeve is in the retracted position in normal percussive operation, wherein said at least one front port is closed by said slide sleeve when said slide sleeve is in the advanced position in idling operation.

5. The percussive tool in accordance with claim 2 wherein said at least one auxiliary port is located so that the rear end of said striker element covers part of said at least one auxiliary port with the remaining part thereof open to the air chamber when said striker element is in its forward position in normal percussive operation.

6. The percussive tool according to claim 5 further comprising:

a second air chamber formed in said cylinder in front of said striker element;

at least one front port formed in said cylinder for placing said second air chamber in communication with the atmosphere; and at least one movable aperture formed in said slide sleeve for opening said at least one front port when said slide sleeve is in the retracted position in normal percussive operation, wherein said at least one front port is closed by said slide sleeve when said slide sleeve is in the advanced position in idling operation.

7. The percussive tool according to claim 2 further comprising:

a second air chamber formed in said cylinder in front of said striker element;

at least one front port formed in said cylinder for placing said second air chamber in communication with the atmosphere; and at least one movable aperture formed in said slide sleeve for opening said at least one front port when said slide sleeve is in the retracted position in normal percussive operation, wherein said at least one front port is closed by said slide sleeve when said slide sleeve is in the advanced position in idling operation.

8. The percussive tool according to claim 1 further comprising:

a second air chamber formed in said cylinder in front of said striker element;

at least one front port formed in said cylinder for placing said second air chamber in communication with the atmosphere; and at least one movable aperture formed in said slide sleeve for opening said at least one front port when said slide sleeve is in the retracted position in normal percussive operation, wherein said at least one front port is closed by said slide sleeve when said slide sleeve is in the advanced position in idling operation.

9. A percussive tool comprising:

a cylinder;

a piston contained and reciprocable in said cylinder;

an air chamber formed adjacent to said piston in said cylinder for creating an air spring therein;

at least one exhaust port formed in the part of said cylinder where said air chamber is located;

a striker element contained in said cylinder and capable of being interlocked with said piston via said air spring created in said air chamber to transmit a percussive motion performed by said piston to a tool bit mounted at a front end of the percussive tool;

an axially displaceable slide sleeve mounted around said cylinder and urged forward, said slide sleeve being retracted to close said at least one exhaust port formed in said cylinder when said percussive motion is transmitted and being advanced to open said at least one exhaust port during id ling operation;

a second air chamber formed in said cylinder in front of said striking element; and ventilation control means for restraining the effect of said air spring in said air chamber by placing said air chamber in communication with said second air chamber at least for a predetermined time period after said at least one exhaust port is closed by said slide sleeve during a switchover from idling operation to normal percussive operation.

10. The percussive tool in accordance with claim 9 wherein said ventilation control means comprises a recess formed in the inner surface of said cylinder and an air path formed around the peripheral surface of said striker element, said air path extending from part of said striker element near its rear end to said second air chamber, wherein said recess is only partially closed by said striker element when said at least one exhaust port is completely closed by said slide sleeve, thereby placing said air chamber in communication with said second air chamber.

* * * * *